US006834466B2

(12) United States Patent
Trevorrow et al.

(10) Patent No.: US 6,834,466 B2
(45) Date of Patent: Dec. 28, 2004

(54) SNOW GUARD

(75) Inventors: Thomas P. Trevorrow, deceased, late of Hollsopple, PA (US); by Emma J. Trevorrow, legal representative, Hollsopple, PA (US), 650 Gilbert Hollow, Hollsopple Pa. 15935

(73) Assignee: Emma J. Trevorrow, Hollsopple, PA (US)

( * ) Notice: Subject to any disclaimer, the term of this patent is extended or adjusted under 35 U.S.C. 154(b) by 0 days.

(21) Appl. No.: 10/219,229

(22) Filed: Aug. 15, 2002

(65) Prior Publication Data

US 2003/0066247 A1 Apr. 10, 2003

Related U.S. Application Data

(60) Provisional application No. 60/313,270, filed on Aug. 17, 2001.

(51) Int. Cl.[7] ..... E04D 13/10

(52) U.S. Cl. ..... 52/24; 52/25; 52/26; 248/512; 248/535; 403/362; 403/388; 403/396

(58) Field of Search ..... 52/24, 25, 26; 248/512, 535; 403/362, 388, 396

(56) References Cited

U.S. PATENT DOCUMENTS

| | | | | | |
|---|---|---|---|---|---|
| 529,774 | A | * | 11/1894 | Baird | 52/25 |
| 756,884 | A | * | 4/1904 | Parry | 52/25 |
| 2,079,768 | A | * | 5/1937 | Levow | 52/25 |
| 4,125,251 | A | * | 11/1978 | Jamieson, Jr. | 269/45 |
| 4,141,182 | A | | 2/1979 | McMullen | 52/24 |
| 4,200,406 | A | * | 4/1980 | Fuss | 403/231 |
| 4,593,877 | A | * | 6/1986 | van der Wyk | 248/512 |
| 4,637,840 | A | * | 1/1987 | Fujii et al. | 148/251 |
| 5,152,107 | A | | 10/1992 | Strickert | 52/24 |
| 5,228,248 | A | * | 7/1993 | Haddock | 52/25 |
| 5,271,194 | A | | 12/1993 | Drew | 52/25 |
| 5,483,772 | A | | 1/1996 | Haddock | 52/25 |
| 5,491,931 | A | | 2/1996 | Haddock | 52/25 |
| 5,570,557 | A | * | 11/1996 | Kwiatkowski et al. | 52/630 |
| 5,609,326 | A | | 3/1997 | Stearns et al. | 256/12.5 |
| 5,613,328 | A | | 3/1997 | Aliey | 52/25 |
| 5,694,721 | A | | 12/1997 | Haddock | 52/24 |
| 5,715,640 | A | * | 2/1998 | Haddock | 52/545 |
| 5,732,513 | A | * | 3/1998 | Alley | 52/25 |
| 5,901,507 | A | * | 5/1999 | Smeja et al. | 52/24 |
| 5,983,588 | A | * | 11/1999 | Haddock | 52/545 |
| 6,164,033 | A | * | 12/2000 | Haddock | 52/545 |
| 6,223,477 | B1 | * | 5/2001 | Alley | 52/24 |
| 6,256,934 | B1 | * | 7/2001 | Alley | 52/25 |

(List continued on next page.)

OTHER PUBLICATIONS

Handbook For civil Engineers, 4th ed., Mettitt, Loftin & Ricketts, 1995 p. 5.57.*

*Primary Examiner*—Carl D. Friedman
*Assistant Examiner*—Christy M. Green
(74) *Attorney, Agent, or Firm*—Douglas G. Glantz

(57) ABSTRACT

A snow guard for a raised portion on a building surface, having a unitary transparent mounting body is formed from a polycarbonate material. A transparent acrylic snow-holding bar fits into the transparent mounting body. An ice-holding bar also is provided and is formed from clear acrylic. In one aspect, the mounting body includes vertical structural stiffeners 30 by walls 42 of bar supporting central columns 32 and by outside surface 38 of wall 24 and horizontal stiffeners 27 extending downwardly under top 26 and which are integral part of the mounting body and of walls 24 providing a rigid, strong connection of the two structural support sides 28, top portion 26 and horizontal stiffeners 27 and structural support sides 28 all molded in one piece, made of ultraviolet proof, high impact, high izod polycarbonate plastic. In one aspect, the mounting body include bar insertion cavities 46 and stops 52 to prevent snow-holding bar 8 from sliding through its insertion cavities.

20 Claims, 6 Drawing Sheets

U.S. PATENT DOCUMENTS 6,266,929 B1 * 7/2001 Cline ..... 52/24
6,357,184 B1 * 3/2002 Alley ..... 52/25
6,453,623 B1 * 9/2002 Nelson et al. ..... 52/24
6,470,629 B1 * 10/2002 Haddock ..... 52/24
6,499,259 B1 * 12/2002 Hockman ..... 52/26
6,526,701 B2 * 3/2003 Stearns et al. ..... 52/24
6,536,166 B1 * 3/2003 Alley ..... 52/25

* cited by examiner

SNOW GUARD

This application claims the benefit of provisional application No. 60/313,270 filed on Aug. 17, 2001.

BACKGROUND OF THE INVENTION

1. Technical Field

The present invention relates to a snow guard apparatus and method for providing protection from snow and ice falling from a roof. In one aspect, the present invention relates to a snow guard apparatus and method for installation and attachment of a snow guard to a standing seam metal roof.

2. Background

Metal roofs are found on many types of commercial buildings. Metal roofs typically are placed over a plywood or particle board substructure. A metal roof comprises a plurality of metal roofing panels. Each panel has a longitudinal length to cover a span of a roof section, and the panels are laid side by side to cover the width of the roof section. Each panel preferably includes substantially perpendicular edges running along both the left and right sides, and the roofing panels are located such that their substantially perpendicular edges are abutting, thereby forming a seam. The substantially perpendicular edges of abutting panels are each crimped together or bent downwardly over each other to form a joint. The joint seals the adjoining panels, thereby preventing fluid communication breaching to the roofing substructure below the roofing panels, as well as to the area between each roofing panel. Fluid communication to the substructure leads to the substructure becoming rotted, infested, or otherwise losing or degrading structural integrity. Metal roof installers have devised unique patterns for the joints to prevent the breaching of moisture from the exterior surface of the roofing panels to the interior surface via the roofing panel abutment point.

A snow guard is secured to a metal roof to prevent snow from falling off the metal roof, thereby potentially damaging persons and property located in the fall path. A snow guard is attached either to a roofing panel of the metal roof or to the seam of the abutting roofing panels. One attachment method is by screws or bolts. However, both screws and bolts can puncture the roofing panel or seam where they are driven, thereby destroying the hermeticity of the metal roof. While the snow guard is in place, fluid communication preferably is prevented through the holes created by the screws or bolts. Another possible attachment method is by a set screw. Specifically, the snow guard attaches to a groove, a threaded hole from one side of the snow guard to the groove, and an indented portion located in the groove opposite the threaded hole. The set screw typically has a blunt end.

The snow guard is placed over the seam of the metal roof, and the set screw is threaded through the hole. As the set screw is driven into the threaded hole, the blunt end of the set screw contacts a portion of the seam. Further driving the set screw into the hole causes a portion of the seam in contact with the blunt end of the set screw to be driven toward and into the indented portion located in the groove opposite the set screw hole. Bending the seam secures the useful device onto the seam. The set screw tends to tear the seam at the point where the blunt end of the set screw contacts the seam. Specifically, as the blunt end of the set screw is driven further into the hole and contacts the seam, friction is created between the blunt end of the turning set screw and the seam in forced contact therewith. The friction causes the rotational torque imparted to the blunt end as a result of driving the set screw further into the hole to be transferred to the seam. The transferred rotational torque and friction fatigues the seam, causing it to be turned in the same direction as the set screw, thereby producing tears in the seam at the set screw/seam interface. The tears in the seam degrade the hermeticity of the metal roof, leading to possible fluid communication and deleterious consequences.

Snow guards hold snowloads on seamed metal roofs. Snow guards include plates with vertical splines mounted to roofs with mounting blocks, affixed to the splines, fencing flags affixed on top the blocks, and fencing held by the flags. Such snow guard systems permit leakage of moisture down into the buildings covered by the roofs. Sheet metal panels in building construction building attachments interconnect with a metal panel surface. In northern climates, a snow retention snow guard on a metal roof is needed which controls, inhibits, and impedes the movement of snow or ice or combination of snow and icedown the pitch of the roof.

Sliding snow or ice or a combination of snow and ice from roofs can be hazardous to people, the surrounding landscape, property, and building components. Snow or ice sliding from a roof above an entryway may injure passers-by. Similarly, falling snow or ice damages landscape features, such as shrubs and property or building components, including automobiles or lower roofing portions. Sliding snow or ice can shear off antennas, gutters, or other components attached to a building roof or wall, thereby potentially causing a leak.

The problem of sliding snow or ice is particularly experienced in connection with metal roofs, including raised seam roofs, e.g., standing seam roofs, where there is relatively little friction between the roof and the snow or ice. As used herein, the term "raised seam roof" includes a roof formed by a series of panels interconnected to define longitudinal, raised portions. A snow guard controls movement of snow or ice or a combination of snow and ice across or along selected areas of such metal roofs.

Snow guard devices were developed initially for use on tile and shingle roofs. In one type of configuration for use on such roofs, an L-shaped brace has one leg fastened to the roof and another leg which projects upwardly from the roof. The fastening leg is nailed or screwed into the roof beneath a shingle or tile. By positioning and attaching a plurality of these braces to the roof in substantially linear fashion, linear bars are positioned within and through one or more receiving areas of the respective upwardly projecting legs to provide a fence-like configuration for snow or ice or a combination of snow and ice retention. A plurality of braces for receiving the linear bars are positioned on opposite sides of the roof and are interconnected by a harness assembly. By positioning the brace bar assemblies on both sides of the roof, the snow retention snow guard is held in position.

Other snow retention devices for shingle or tile roofs have utilized a more unitary structure.

Another snow retention device is a snow guard plastic barrier having a generally L-shaped cross-section. The snow guard is installed by smearing the underside of the snow guard with silicon intended to provide a weather seal, positioning the snow guard against the roof surface, and attaching the snow guard to the roof with screws such that the screws penetrate the roofing surface and become anchored into an underlying structural member. An adhesive may be used in place of the screws where desired.

A snow guard device for use on trapezoidal-type, standing seam roofs having 24 inch wide panels comprises a horizontal steel member which spans one panel width. The horizontal member is attached at ends to mounting members which straddle the trapezoidal panel ribs. The mounting members are fastened to the panel ribs by screws.

Snow guard devices may cause the roof to leak. Many of the snow guards are attached to the roof by a screw, nail or other fastener which pierces the roofing surface. Such piercing of the roof leads to undesired leakage because of inadequate sealing or shearing of the fastener by the forces exerted by sliding snow or ice or a combination of snow and ice. In an attempt to prevent leakage, sealants or gaskets or a combination of sealants and gaskets are applied around the holes pierced through the roofing surface. However, these measures complicate installation and may not fully prevent leaks. Alternative methods for the attachment of snow guard devices to roofs such as adhesive bonding may fail to provide secure attachment or may be difficult to install on a sloped surface, particularly where the snow guard is applied to a smooth, non-porous roofing material such as metal.

Snow guard devices can cause undesired pinning of the roofing materials. Metal roofing sheets are designed to be moveable to accommodate normal thermal expansions and contractions. Where snow guard devices are attached to the roof by a screw or nail which pierces the roofing surface and is anchored into an underlying structural member or deck, the designed thermal movement characteristics of the roof are compromised, thereby adversely affecting the roof's performance.

Snow guard devices are not readily adaptable for use in a broad range of raised seam roofing applications. Some of the snow guards are not intended for raised seam roofing applications at all but, rather, are primarily for use on shingled or other non-raised seam roofs. Other snow guards are designed for use on raised seam roofs having a particular panel width and seam profile and cannot be easily adjusted for use in connection with panels of differing widths or seams of various profiles. Moreover, some snow guard devices are connected permanently to a roof such that the snow guard cannot be easily repositioned as may be desired.

Snow guard devices comprise a snow blocking element having a height, relative to the roof surface, which is unadjustable, difficult to adjust, or adjustable only between a small range of predetermined positions. Accordingly, the user's ability to adjust such snow guard devices, for particular conditions with respect to snowfall or drifting is limited.

Snow guard apparatus are intended to prevent sheets of snow from sliding off roofs where snow has accumulated. In climates experiencing snow and prolonged cold weather, snow accumulating on roofs becomes a potential safety hazard. After snow has fallen onto a roof, it may remain in place during cold temperatures for an indeterminate period of time. Eventually, as the snow melts, large sheets of snow break off from the accumulated snow. If the roof on which the snow has accumulated is sloped, such sheets suddenly fall off the roof onto unsuspecting individuals or property. The weight of snow sheets frequently is so significant as to cause injury to individuals and serious damage to property.

The potential hazard caused by accumulated snow is particularly dangerous when snow is found on a sheet metal roof. These roofs provide a slippery surface which facilitates sliding of sheets of snow.

A variety of snow guards for preventing snow from falling from particular types of roofs are found in the prior art. West German Patent 2126082, West German Patent 2523087, Austrian Patent 222329, and Switzerland patent 204783 each disclose a type of snow blocking snow guard involving an elongated member held above the roof. The elongated member is held in place by two parallel plates secured to each other positioned on either side of a roof seam. Particular roof designs in which the roof seams snugly fit in between two parallel plates are not easily adapted to fit roof seams of a size or configuration different from the one for which each is designed.

U.S. Pat. No. 2,201,320 issued to Place teaches the use of multiple sheet metal strips with bent ends to hook over roof seams. Such snow guards are manufactured to fit the exact distance between adjacent roof seams.

Brackets attached to roof seams to support elongated supports used as scaffolds are described in U.S. Pat. No. 1,054,091 issued to Darnall. The Darnall mechanism prevents masses of snow from falling from a roof. Each bracket includes a cam lever which engages a roof seam to attach the bracket to the seam.

Three West German Patents 2845104, 2845103, and 3716491 disclose mechanisms used to trap snow on a roof and rely on a plurality of snow retainers, each independently attached to a roof seam. In some cases, the retainer appears to be attached to the seam by means of a screw which penetrates the seam, thus possibly lessening the structural integrity of the seam and inviting leaks in the roof. A snow guard in U.S. Pat. No. 507,776 issued to Berger et al. has teeth or projections which pierce the roof seam with possible detrimental results.

While prior snow guard mechanisms are useful for an intended purpose, no mechanism is available which is aesthetically attractive when installed to prevent masses of snow from falling from a metal roof with standing seams. There is a need for a mounting snow guard positioned on a metal panel surface without adversely affecting roof performance. There exists a need for a snow guard and method which provide an aesthetic appearance and which provide a snow guard secured onto metal roofs of a variety of shapes and sizes, which will decrease the hazard created by sliding snow masses.

OBJECTS OF THE INVENTION

It is an object of the present invention to provide an on-the-roof ice and snow-holding apparatus that is easily installed, not requiring special skills for its installation and which is easily relocatable.

It is another object of the present invention to provide an on-the-roof ice and snow holding apparatus that will not puncture or brake, or tear up the seams it is installed upon.

It is yet another object of the present invention to provide an on-the-roof ice and snow holding apparatus that also holds back ice, not only snow.

It is still another object of the present invention to provide an on-the-roof ice and snow holding apparatus that is not corrodible and U.V. proof.

It is another object of the present invention to provide and on-the-roof ice and snow holding apparatus that is aesthetically pleasing and which can be made to match various roof colors when required.

SUMMARY OF THE INVENTION

A snow guard for a raised portion on a building surface, having a unitary transparent mounting body is formed from a polycarbonate material. A transparent acrylic snow-holding bar fits into the transparent mounting body. An ice-holding bar also is provided and is formed from clear acrylic. In one aspect, the mounting body includes vertical structural stiffeners 30 by walls 42 of bar supporting central columns 32 and by outside surface 38 of wall 24 and horizontal stiffeners 27 extending downwardly under top 26 and which are integral part of the mounting body and of walls 24 providing a rigid, strong connection of the two structural support sides 28, top portion 26 and horizontal stiffeners 27 and structural support sides 28 all molded in one piece, made of ultraviolet proof, high impact, high izod polycarbonate plastic. In one aspect, the mounting body include bar insertion cavities 46 and stops 52 to prevent snow-holding bar 8 from sliding through its insertion cavities.

DETAILED DESCRIPTION

Figure 1:
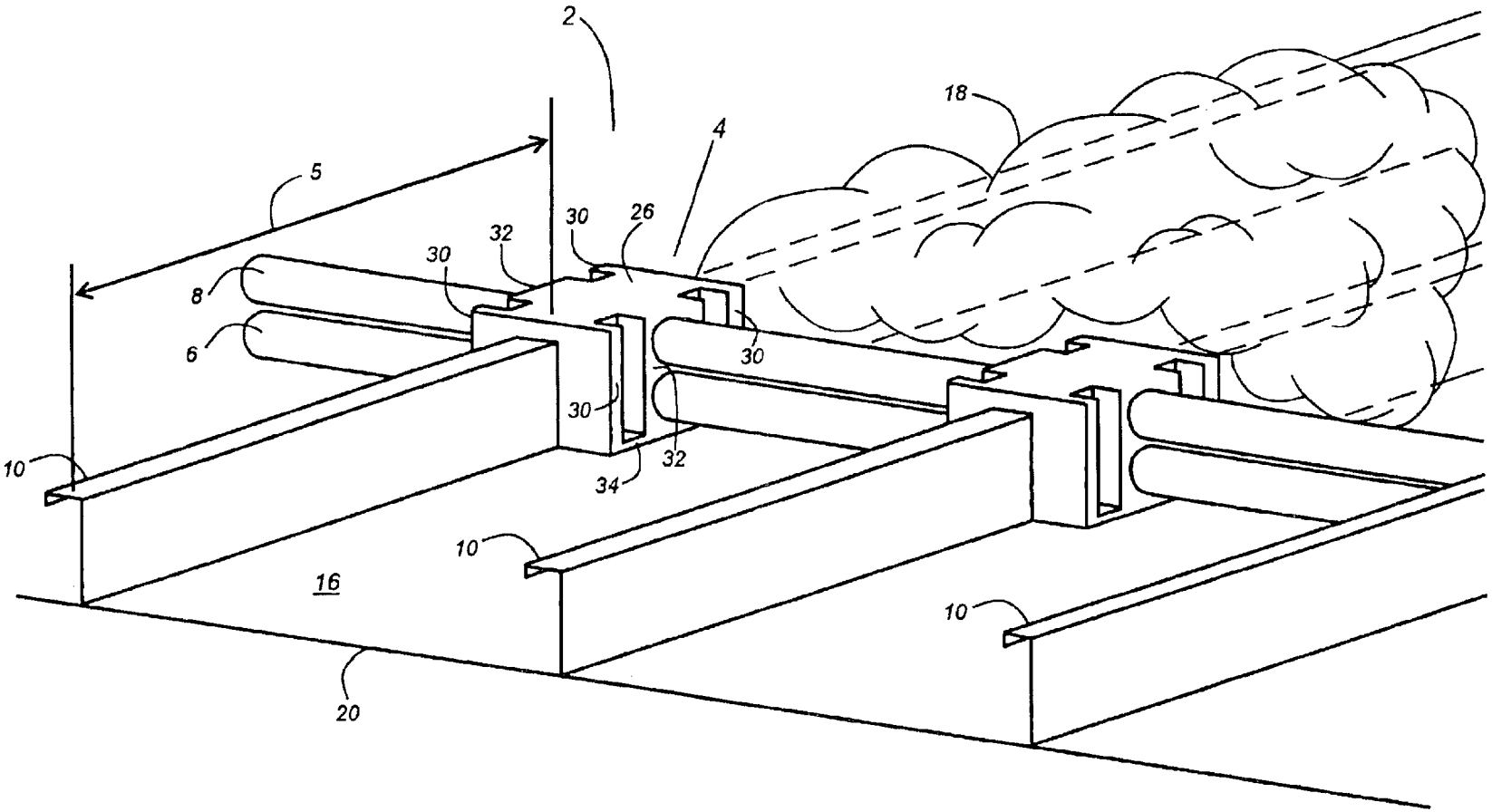
FIG. 1 is a perspective view of the on-the-roof ice and snow holding apparatus of the present invention shown installed on a standing seam roof, showing its support device and its holding bars.

A snow guard device and method are provided for installation and attachment to a metal roof having a substantially perpendicular seam. The snow guard and method of the present invention include a block, a groove in the base of the block, such that the block is locatable on the roof by placement of the groove on the seam. In one aspect, a threaded hole is located in the block between a first side wall and the groove, and a cavity is located in the groove diametrical to the threaded hole. A set screw is locatable in the threaded hole.

In one aspect, the instant invention relates to a snow guard device and method to prevent snowloads from cascading off roofs and onto persons or structures below the edges of such roofs.

The apparatus and method of impeding snow from sliding off metal roofs include a series of generally U-shaped, attachment snow guards which straddle a roof seam. Each attachment snow guard is secured by screwing a blunt edged screw into a hole in a prong of that attachment snow guard apparatus to tighten that snow guard apparatus against the roof seam, without penetrating the seam. Each attachment snow guard is provided with a bar receiving channel to hold a bar perpendicular to the seams, to prevent large masses of snow from sliding off the roof.

A snow guard and method for sloped or inclined roofs provide a snow guard rendered essentially invisible and which is corrosion proof.

Snow guards are employed for fixed mounting to the lower ends of inclined building roofs, particularly in areas of the roof carrying gutters or other water collecting systems and above such gutters or water collecting systems to prevent the movement of snow or ice that accumulates on roofs and minimizing the possibility of damage to the gutters or water collection systems. Presently, such snow guards are formed of cast metal such as iron or fabricated from sheet metal such as steel. The metal snow guards are sometimes coated for resistance to corrosion. Snow guards are responsible for marking or streaking of the roof surfaces because of corrosion during weathering over an extended time period, such corrosion in the cast metal or fabricated metal portions, particularly the metal base.

Snow guards of cast aluminum prevent streaking of corrosion of the fabricated metal snow guards, but cast aluminum results in streaking of the roof below the snow guard, since aluminum anodizing produces a readily visible darkening stain distinct from the red rust condition normally attributed to cast metal snow guards such as cast iron or fabricated steel readily visible. The snow guard formed of unitary cast construction or wholly or partially of fabricated metal or the cast metal iron or aluminum produces some discoloration to the roof because of corrosion or anodizing of the snow guards.

Snow guards are located at prominent portions of the roof and easily seen from the ground. Snow guards formed of opaque material such as cast iron, cast aluminum, or fabricated metal are distinct in appearance and a visual distraction of the roof from its normal architectural esthetics.

The snow guard and method of the present invention will be better understood when the following detailed description is studied with reference to the accompanying drawings, which help in illustrating its most important features.

Referring now to FIG. 1, a perspective view, the on-the-roof ice and snow holding apparatus 2 of the present invention is shown fully assembled upon standing seam metal roof 16 at a predetermined distance 5 from roof edge 20. Standing seam metal roof 16 is shown on FIG. 1 with L-shape standing seams 10. The on-the-roof ice and snow holding apparatus 2 comprises three main component parts, including support device 4, ice-holding bars 6, and snow-holding bars 8. The on-the-roof ice and snow holding apparatus 2 is attached firmly to L-shape standing seam 10 by means of four stainless steel Allen button head screws 54, 56 not shown on FIG. 1 but shown on FIGS. 5, 6 and 7.

Support device 4 is set firmly upon standing seam metal roof 16, i.e., with its base 34 firmly set upon standing seam metal roof 16 and showing its two central columns 32, four vertical structural stiffeners 30, and top portion 26. Support device 4 is made of high impact resistant, high izod polycarbonate plastic. Support device 4 is very strong and aesthetically pleasing.

Figure 5:
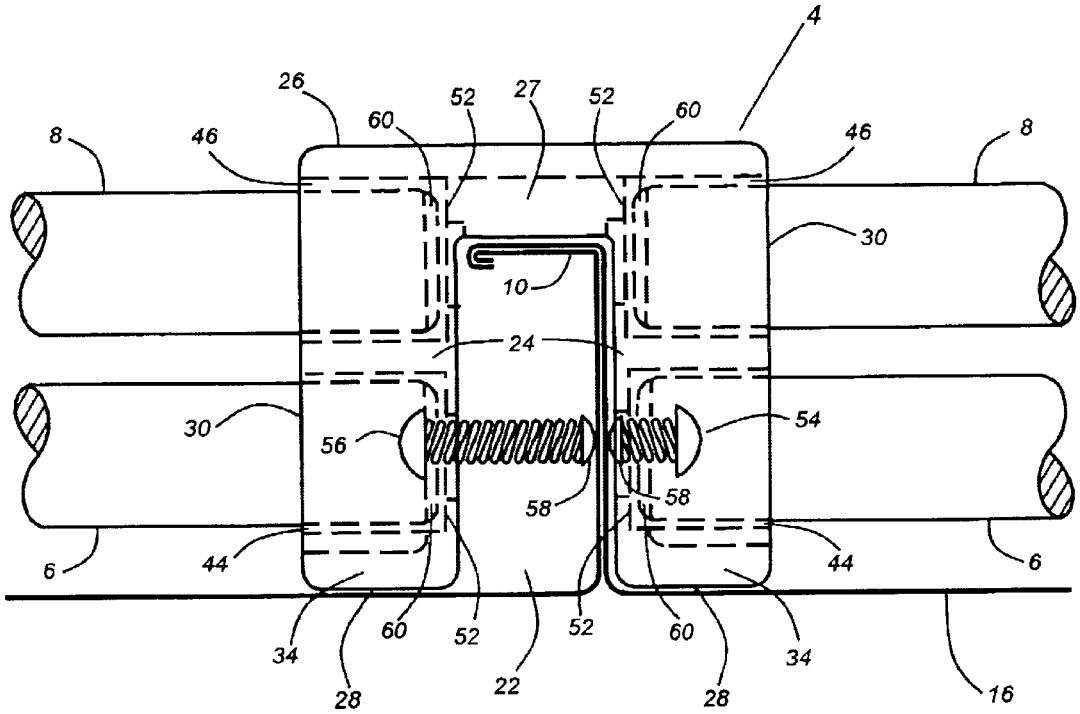
FIG. 5 is a front elevation view of the support device of FIG. 2, shown installed on an L-shape standing seam metal roof; it also shows its holding bars installed.
Figure 6:
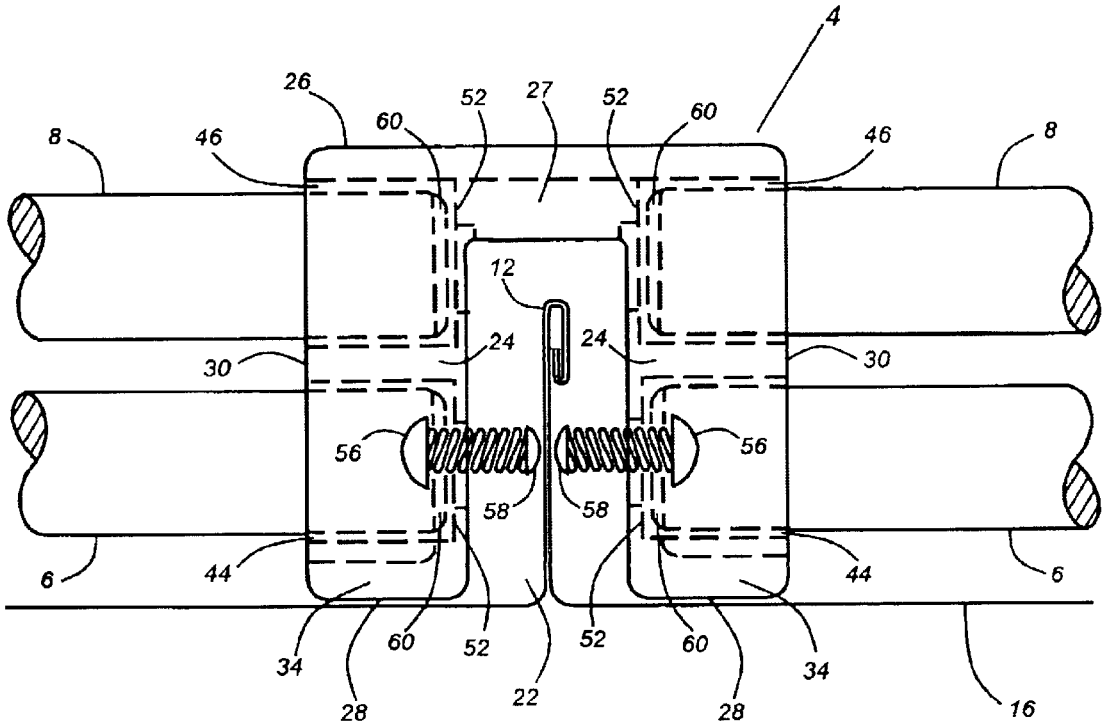
FIG. 6 is a front elevation view of the support device of FIG. 2, shown installed on a straight shape standing seam metal roof; it also shows its holding bars installed.
Figure 7:
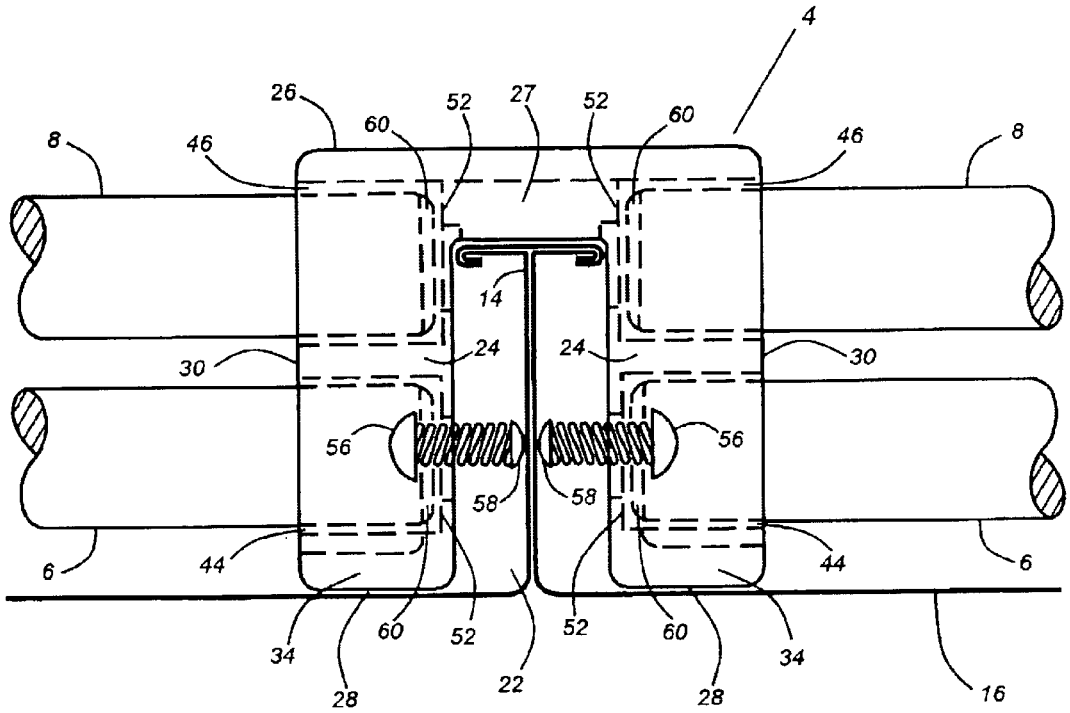
FIG. 7 is a front elevation of FIG. 2, shown installed on a T-shape standing seam metal roof; it also shows its holding bars installed.

Ice-holding bars 6 and snow-holding bars 8 are made of one inch diameter, clear acrylic, round bars, and they are inserted in their respective bar insertion cavities, as it will be further described in more detail in this detailed description, in connection with FIGS. 5, 6 and 7. Ice-holding bars 6 and snow-holding bars 8 prevent sheets of ice (not shown) and packed snow 18, respectively, from sliding down the standing seam metal roof 16, thus preventing dangerous accidents, dangerous to humans, pets or property that might be below the roof edge 20 of the standing metal roof 16. Ice-holding bars 6 and snow-holding bars 8 can be made of various standard lengths which provides easiness of application to any standard standing seam spacings.

Figure 2:
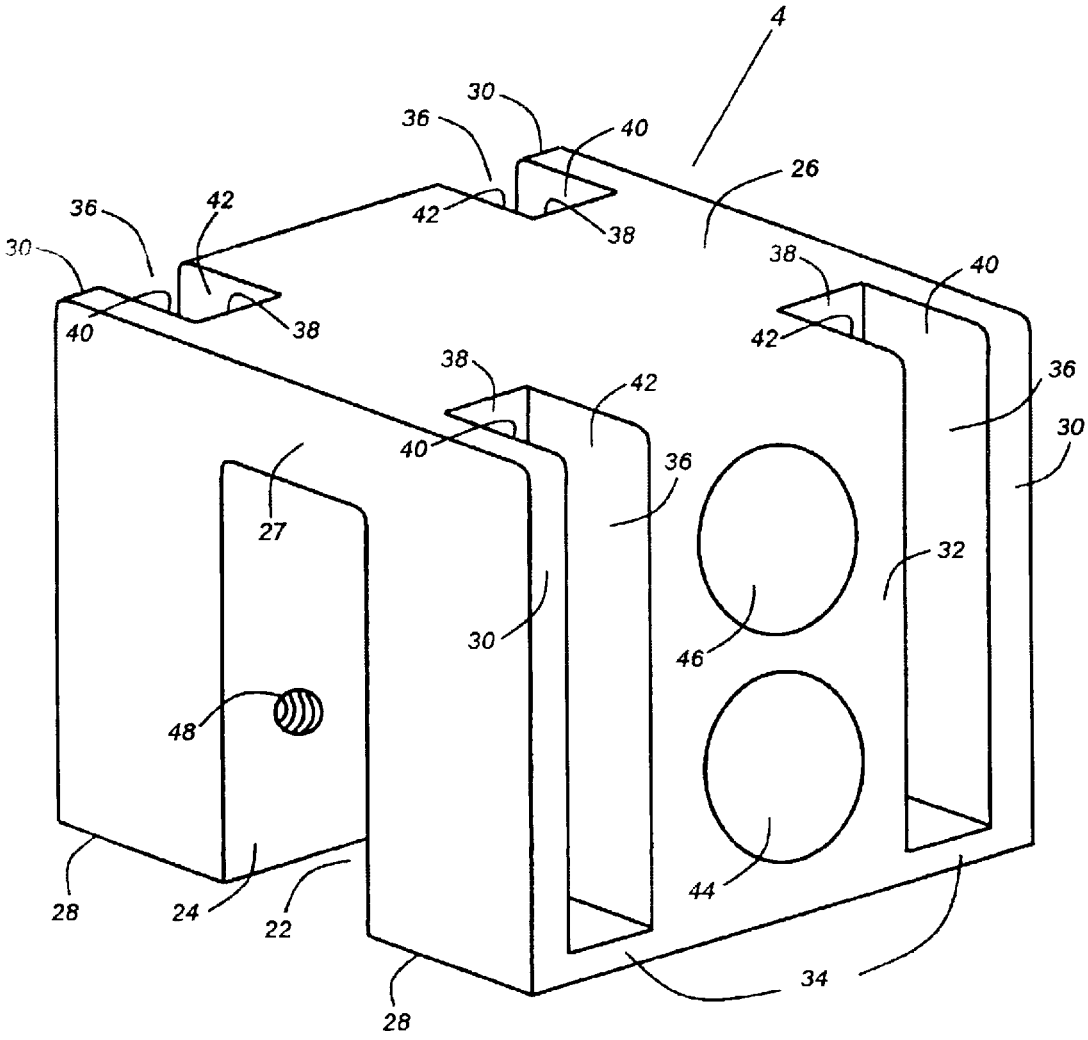
FIG. 2 is a perspective view of the support device component part of the present invention.
Figure 3:
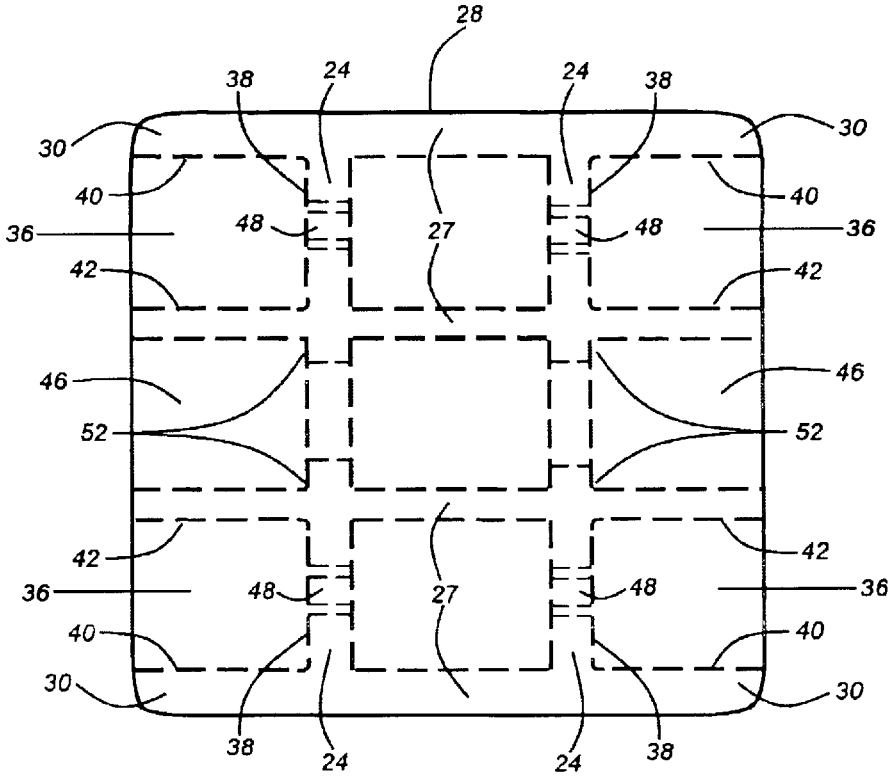
FIG. 3 is a transparent view from the top of the support device of FIG. 2.

Referring now to FIG. 2, a perspective view of support device 4 and to FIG. 3, a transparent top view also of support device 4, a component part of the instant invention. Support device 4 is preferably molded, in one piece, preferably made of high impact resistant and ultraviolet protected, high izod polycarbonate plastic; it can also be molded, if needed, from aluminum and other metals. The support device 4 comprises two structural support sides 28 and a top portion 26 which joins together the two structural support sides 28 at their top ends; top portion 26 is of at least ¼ inch in thickness. Structural support sides 28 provide therefore central longitudinal opening 22, which in turn provides two inside walls 24, only one inside wall 24 is shown on FIG. 2. The inside walls 24 are of at least ¼ inch in thickness. Each structural support side 28 is provided with two vertical structural stiffeners 30, for a total of four and with one bar supporting central column 32 and an integral support base 34. The vertical support stiffeners 30 and integral structural bases 34 are at least of ¼ inch in thickness. On each side of each of the two bars supporting central columns 32 there is a vertical space 36, for a total of four vertical spaces 36. Each of these vertical spaces 36 is defined by outside surface 38 of walls 24, by inside surfaces 40 of vertical structural stiffeners 30 and by surfaces 42 of bar supporting central column 32.

Each bar supporting central column 32, provides one ice-holding bar insertion cavity 44 for inserting ice-holding bar 6 and one snow-holding bar insertion cavity 46 for inserting snow-holding bar 8. Each outside surface 38 of inside walls 24 is provided with one inside threaded hole 48, for a total of four, only one shown on FIG. 2, all four shown on FIG. 3.

Figure 4:
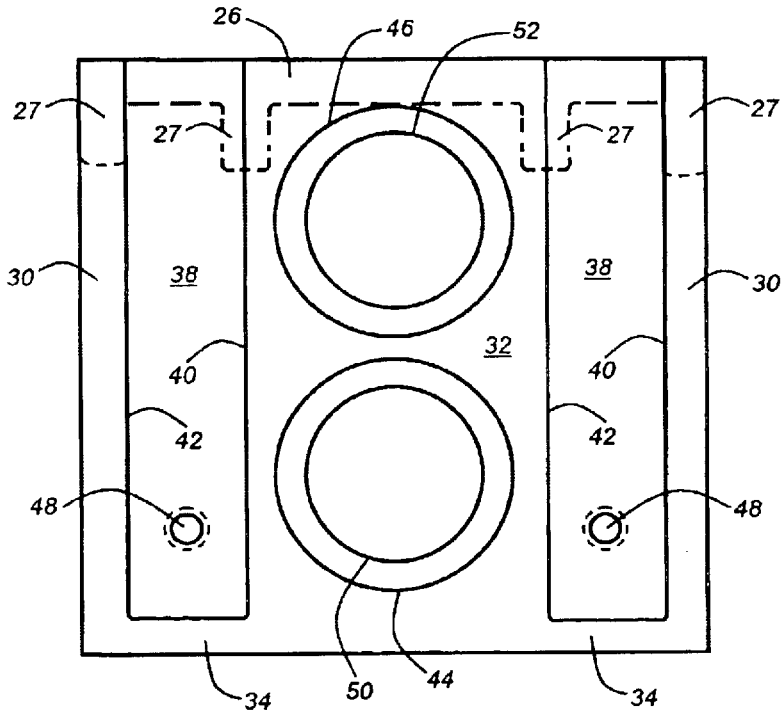
FIG. 4 is a right side elevation view of the support device of FIG. 2.

The underside of top portion 26 is provided with four ¼ inch thick horizontal stiffeners 27, only one shown on FIG. 2, all four are shown on FIGS. 3, 4.

Referring now to FIG. 3, a transparent view of support device 4 seen through its top 26, on this FIG. 3, it can be better seen, all four vertical spaces 36, each one formed by inside surfaces 40 of vertical structural stiffeners 30, by walls 42 of bar supporting central columns 32 and by outside surface 38 of wall 24.

Bar insertion cavities 46 provide stops 52 in order to prevent the snow-holding bar 8 from sliding through its insertion cavities 46, e.g., hole 46.

Horizontal stiffeners 27 extend downwardly under top portion 26 and are integral part of it and of walls 24 providing a very rigid, strong connection of the two structural support sides 28, top portion 26; horizontal stiffeners 27 and structural support sides 28 are all molded in one piece, made of ultraviolet proof, high impact, high izod polycarbonate plastic; support device 4, therefore is not corrodible. Horizontal stiffeners 27 are at least ¼ of an inch in thickness. All four inside threaded holes 48 can be seen on FIG. 3, and they are on walls 24, sized to accept at least 5/16 of an inch diameter stainless steel screws.

Referring now to FIG. 4, a right side elevation view of support device 4 component of the present invention, it shows one of its two identical structural support sides 28. Also shown are vertical structural stiffeners 30, with integral structural base 34, structural stiffeners 27 seen in phantom lines, outside surfaces 38 of vertical spaces 36, with its inside threaded holes 48 and bar supporting central column 32, with one ice-holding bar insertion cavity 44, with its ice bar stop 50 and with one snow-holding bar inserting cavity 52 with its snow bar stop 52. The left side elevation of support device 4 is identical to the right side elevation shown on FIG. 4.

Referring now to FIG. 5, a front elevation view of support device 4 a component of the present invention. FIG. 4 shows the support device 4 installed on standing seam metal roof 10, with L-shape standing seams 10. Support device 4 is set over L-shape standing seam 10, e.g., with L-shape standing seam 10 inside the central longitudinal opening 22 of support device 4. Two short, stainless steel, Allen button head screws 54, only one is shown in FIG. 5, are threaded in through inside threaded holes 48 of FIG. 3 on each of the two structural support sides 28 and two long, stainless steel, Allen button head screws 56, only one is shown on FIG. 5, are threaded in through inside threaded holes 48, of FIG. 3 on the opposite structural support side 28. Allen button head screws 54, 56, are threaded in until they both touch the L-shape standing seam, 10, on their respective sides, then they are torqued enough to immobilize support device 4 against the L-shape standing seam 10 and with bases 34 of support device 4, firmly resting upon metal roof 16. Allen button head screws 54, 56 have rounded tips 58, i.e., rounded ends 58. The rounded tips 58 are preferred over blunt end types, by the way of an example, because they prevent tearing up and puncturing through L-shape standing seams 10 while torquing screws 54, 56 and therefore preventing leaks down to the roof's substructure through punctured or broken L-shape standing seams 10. Allen button head screws 54, 56 are made of stainless steel and therefore they are not corrodible.

FIG. 5 also shows the two ice-holding bar insertion cavities 44, one on each structural support side 28 of support device 4. One ice-holding bar 6 is shown inserted into each ice-holding bar insertion cavity 44. Ice-holding bars 6 can not go through, they are stopped by stops 52. Ice-holding bars 6 are installed at approximately ⅜ of one inch from the surface of standing seam metal roof 16 to the bottom of the bars. This measurement is not proportionately shown on FIG. 5. Ice-holding bars 6 prevent ice, (not shown on FIG. 5), formed on standing seam metal roof 16, from sliding down from the standing seam metal roof 16. Sheets of ice, not shown, are very hazardous if they slide down upon humans, pets or property located below roof edge 20.

FIG. 5 also shows the two snow-holding bar insertion cavities 46 one on each structural support side 28 of support device 4. One snow-holding bar 8 is shown inserted into each snow-holding bar insertion cavity 46. Snow-holding bars 8 cannot go through, but they are stopped by stops 52. Snow-holding bars 8 are installed at approximately 2¾ inches from the surface of metal roof 16 to the top of the bars 8. This measurement is not proportionately shown on FIG. 3. Snow-holding bars 8 prevent heavy, packed snow 18, accumulated on standing seam metal roof 16, from sliding down from standing seam metal roof 16. Heavy, packed snow, not shown, are also very hazardous if they slide down upon humans, pets, or property located below roof edge 20.

Ice-holding bar 6 and snow-holding bar 8 fit loosely inside their respective insertion cavities 44, 46. Ice-holding bars 6 and snow-holding bars 8 preferably are made of one inch diameter clear acrylic plastic and with chamfered ends 60, in order to facilitate insertion in their respective insertion cavities 44, 46. Ice-holding bars 6 and snow-holding bars 8 are strong and aesthetically pleasing.

On FIG. 5 can also be seen the two structural support sides 28 of support device 4, its ¼ of one inch thick walls 24, top portion 26, horizontal structural stiffeners 27 (only one shown), vertical structural stiffeners 30, only two are shown and bases 34 which combined form a one piece, solid, and aesthetically pleasing support device 4.

Referring now to FIG. 6, a front elevation view of support device 4, showing the support device 4 installed on a standing seam metal roof, this time with straight standing seams 12. Support device 4 is set over straight standing seam 12, i.e., with straight standing seam 12, inside the central longitudinal opening 22 of support device 4. For this type of standing seams, four long stainless steel Allen button head screws 56 are utilized, only two are shown on FIG. 6, each threaded through a respective inside threaded hole 48 of FIG. 3, two Allen button head screws 56 on each of the two structural support sides 28, only one is shown on each structural support side 28 on FIG. 6. Allen button head screws 56 are threaded in until they touch the straight standing seam 12 on their respective sides, then they are torqued enough to immobilize support device 4 against the straight standing seam 12 and with support device 4 bases 34 firmly resting upon metal roof 16.

Allen button head screws 56 have rounded tips 58, i.e., rounded ends 58. The rounded tips 58 are preferred over blunt end types or set screws, by the way of an example, because they prevent puncturing through and tearing up straight standing seams 12 while torquing screws 56 and therefore preventing leaks down to the roof substructure through punctured or broken straight standing seams 12. FIG. 6 is in all other respects identical to FIG. 5.

Referring now to FIG. 7, also a front elevation view of support device 4 of the present invention, it shows the support device 4 installed on a standing seam metal roof, now with T-shape standing seams 14. Support device 4 is set over T-shape standing seam 14, i.e., with T-shape standing seam 14 inside the central longitudinal opening 22 of support device 4. For this type of standing seams, four long stainless steel Allen button head screws 56 are utilized, only two are shown on FIG. 7, each threaded through a respective inside threaded hole 48 of FIG. 3, two Allen button head screws 56 on each of the two structural support sides 28, only one screw 56 is shown on each structural support side 28 of FIG. 7. Allen button head screws 56 are threaded in until they touch the T-shape standing seam 14 on their respective sides, then they are torqued enough to immobilize support device 4 against the T-shape standing seam 14 and with support device 4 bases 34 firmly resting upon metal roof 16.

Allen button head screws 56 have rounded ends 58, i.e., rounded tips 58. Key ends are used on screws. The rounded ends 58 are preferred over blunt end types, by the way of an example, because they prevent puncturing and tearing up T-shaped standing seams 14 while torquing screws 56 and therefore preventing leaks down to the roof substructure through punctured or broken seams 14. FIG. 7 is in all other respects identical to FIGS. 5, 6.

One valuable advantage of this invention is the fact it also stops accumulated ice, not shown, not only accumulated snow, 18 FIG. 1, from sliding down metal roofs, which represent a hazard to humans as well as to property when left unchecked. This very valuable advantage of the invention is achieved because ice-holding bars 6 are installed on support device 4 with their bottoms at least ⅜ of one inch from the surface of standing seam metal roof 16, thus preventing sheets of ice (not shown) from sliding down and off the edge 20 of the standing seam metal roof 16, seriously endangering humans, pets, and property below it.

Another valuable advantage of the on-the-roof ice and snow holding apparatus 2 of this invention is that it can be easily installed without requiring any special skills or tools and it can be easily repositioned as well.

Yet another advantage of the invention is the fact the standing seams are not punctured or broken during its installation, thus maintaining the integrity of the roof and therefore preventing leaks created by punctured-through seams.

Still another advantage is that this invention is not corrodible because of the high impact polycarbonate material and the acrylic material it is made of and the stainless steel screws utilized in its installation.

Other advantages of the on-the-roof snow holding apparatus of this invention are:

It is aesthetically pleasing, unobtrusive, UV protected, e.g., it will not fade or break down from sun or harsh weather, and it can be made in various colors to match any roof design requirements.

The method of installation of the on-the-roof ice and snow holding apparatus 2 of the present invention is very simple, and it does not require special skills or complicated tools. All that is required is one 5⁄16 of an inch Allen wrench, for torquing the short and long Allen button head screws 54, 56, a simple measuring tape, a pencil, and of course, a ladder.

The installation method will be explained in reference to FIGS. 1, 5, 6, and 7.

By the method of this invention, the on-the-roof ice and snow holding apparatus of this invention preferably is installed at a predetermined distance 5 from roof edge 20 of FIG. 1, of standing seam metal roof 16, of approximately twenty-four inches, by the way of an example.

It is preferred that the apparatus of the invention be installed on a straight line, parallel to roof edge 20, in order to hold any fallen, packed snow 18 and any sheet of ice (not shown) formed in the spaces between the standing seams.

Sheets of ice (not shown) will be held behind ice-holding bars 6, while packed snow 18 will be held behind snow-holding bars 8, when there are ice-sheets and by both ice-holding bars 6 and snow-holding bars 8 when there are no ice on standing seam roof 16.

Before climbing on a ladder and before getting on top of the roof, the installer threads in the Allen button head screws through inside threaded holes 48 of a good number of support devices 4, in order to have a sufficient number of support devices 4 ready for installation when he/she climbs upon metal roof 16. The installer shall also take upon metal roof 16 an adequate number of ice-holding and snow-holding bars 6, 8. It makes only sense to carry everything inside a box. By doing that, before climbing, it would minimize the number of ups/downs the ladder.

The installation of the apparatus of this invention can be started from either the right or the left side of standing seam metal roof 16. Depending on how close to roof edge 20 is the on-the-roof ice and snow holding apparatus 2 going to be installed, the installer could perform his/her work from a ladder or by climbing on top of standing seam metal roof 16. In either case, all OSHA recommended safety precautions should be followed. If the installer climbs upon metal roof 16, he/she, for safety purposes, should perform the installation work, with the installer on the roof, facing roof edge 20.

Now the installer, utilizing a simple metal measuring tape, measures the predetermined distance 5 at which he/she is going to be installing the apparatus of the invention, from roof edge 20 and makes a mark, with a pencil, on the first seam 10 the installation will begin at. The installer also marks the next seam 10 at the same predetermined distance 5 from edge 20.

Next the installer places one support device 4 over standing seam 10, with standing seam 10 inside central longitudinal opening 22 of support device 4, and then he/she further threads in Allen button head screws 54, 56 in order to tighten support device 4, but without immobilizing it. Now the installer makes sure that bottom edge 3, FIG. 1, coincides with the pencil mark he/she made on seam 10, or on metal roof 16, by the way of an alternate example. That pencil mark defines the predetermined distance 5 at which this first support device 4 is being installed. Then the installer tightens, i.e., torques the Allen button head screws sufficiently, to immobilize support device 4 against standing seam 10. Next the installer inserts one ice-holding bar 6 and one snow holding bar 8 into their respective bar insertion cavities 44, 46 all the way in up to their respective stops 52. Now the installer takes a second support device 4 (to be installed) in one hand, and holds it over the second standing seam 10, while with his/her other hand, he/she inserts ice-holding bar 6 and snow holding bar 8 into their respective bar insertion cavities 44, 46 of the second support device 4 he/she is holding in one hand over the second standing seam 10. At this point ice and snow holding bars 44, 46 cannot slide out, because they are inserted into bar insertion cavities 44, 46 of both support devices 4. Now he/she finally lowers the second support device 4 and sets it over the second standing seam 10, with standing seam 10 inside central longitudinal opening 22 of support device 4.

The installer now proceeds to further tighten the Allen button head screws, but without immobilizing support device 4. Then he/she makes sure that bottom edge 3, FIG. 1 of the second support device 4 coincides with the pencil mark he/she has previously made on the second seam 10, or on its side of metal roof 16, by the way of an alternate example. That pencil mark defines the predetermined distance 5 for installing the second support device 4. Now the installer proceeds to torque the Allen button head screws, in order to immobilize support device 4 against the second standing seam 10.

The installer then proceeds to install the third support device 4 on the third standing seam 10 in the same manner as the second one. He/she has to measure, first, the predetermined distance 5 before installing each subsequent support device 4, make a pencil mark on standing seam 10 or on its side of standing seam metal roof 6, then the installation process is repeated as described above, until all the support devices 4 and all the ice-holding bars 6 and all the snow-holding bars 8 are installed upon standing seam metal roof 16.

A complete list of identifying indicia numerals is provided as follows.

LIST OF IDENTIFYING NUMERALS

| NUMERAL | DESCRIPTION |
|---|---|
| 2 | On-The-Roof Ice and Snow Holding Apparatus of the Present Invention |
| 3 | Bottom Edge of Structural Sides 28 |
| 4 | Support Device |
| 5 | Predetermined Distance from Roof Edge 20 |
| 6 | Ice Holding Bars, One Inch Diameter |
| 8 | Snow Holding Bars, One Inch Diameter |
| 10 | L-Shape Standing Seam |
| 12 | Straight Standing Seam |
| 14 | T-Shape Standing Seam |
| 16 | Standing Seam Metal Roof |
| 18 | Packed Snow, on Metal Roof 16 |
| 20 | Roof Edge |

-continued

| NUMERAL | DESCRIPTION |
|---|---|
| 22 | Central Longitudinal Opening on Device 4 |
| 24 | Inside Walls of Support Device 4 |
| 26 | Top Portion of Support Device 4 |
| 27 | Horizontal Stiffeners (¼ inch thick) |
| 28 | Structural Support Sides of Device 4 |
| 30 | Vertical Structural Stiffeners of Device 4 |
| 32 | Bar Supporting Central Columns of Device 4 |
| 34 | Integral Structural Bases |
| 36 | Vertical Space |
| 38 | Outside Surface of Walls 24 |
| 40 | Inside Surface of Vertical Structural Stiffeners 30 |
| 42 | Walls of Columns 32 |
| 44 | Ice Bar Insertion Cavities |
| 46 | Snow Bar Insertion Cavities |
| 48 | Inside Threaded Holes Through Walls 24 |
| 50 | Ice Bar Stops |
| 52 | Snow Bar Stops |
| 54 | Short Allen Button Head Screws |
| 56 | Long Allen Button Head Screws |
| 58 | Rounded Tips, i.e., Rounded Ends ot Screws 54, 56 |

The snow guard apparatus of the present invention and the manner and method of making and installing the snow guard of the present invention are not intended to be limited to the specific embodiments disclosed and described in the specification but should be construed to extend to the scope of the appended claims and equivalents thereof.

What is claimed is:

1. A snow guard attachable to a raised portion on a building surface, said snow guard comprising:

(a) a unitary transparent mounting body having first and second longitudinally-extending, laterally-displaced structural support sides, vertically-displaced top portion and bottom portion, said longitudinally-extending, laterally-displaced first and second structural support sides having a central longitudinal opening integrally formed in said mounting body defining a portion of said bottom portion, said central longitudinal opening defining a portion of each of said first and second structural support sides and extending between said first and second structural support sides, said central longitudinal opening comprising first and second inside walls and being adapted for receiving at least an upper part of a raised portion on a building surface and further having first and second insertion cavities in said mounting body, said first insertion cavity being on said top portion of a central column for providing attachment capabilities to said mounting body;

(b) a transparent snow-holding bar capable of fitting into said transparent mounting body; and (c) vertical structural stiffeners and horizontal stiffeners integral to said mounting body.

2. A snow guard as set forth in claim 1, wherein said mounting body is formed from a polycarbonate material.

3. A snow guard as set forth in claim 1, wherein said transparent snow-holding bar is formed from clear acrylic.

4. A snow guard as set forth in claim 2, wherein said transparent snow-holding bar is formed from clear acrylic.

5. A snow guard as set forth in claim 4, further comprising an ice-holding bar formed from clear acrylic.

6. A snow guard as set forth in claim 5, wherein said mounting body comprises:

vertical structural stiffeners (30) provided by walls (42) of bar supporting central columns (32) and by outside surface (38) of wall (24) and horizontal stiffeners (27)

extending downwardly under top (26) as an integral part of said mounting body and of said walls (24), to form a rigid connection of two structural support sides (28), top portion (26), horizontal stiffeners (27), and structural support sides (28) molded in one piece of ultraviolet proof, high impact, high izod polycarbonate plastic.

7. A snow guard as set forth in claim 6, wherein said mounting body further comprises bar insertion cavities (46) and stops (52) to prevent snow-holding bar (8) from sliding through its insertion cavities.

8. A method of providing a snow guard, comprising:

(a) providing a unitary transparent mounting body having a first and second longitudinally-extending, laterally-displaced structural support sides, vertically-displaced top portion and bottom portion, said longitudinally-extending, laterally-displaced first and second structural support sides having a central longitudinal opening integrally formed in said mounting body defining a portion of said bottom portion, said central longitudinal opening defining a portion of each of said first and second structural support sides and extending between said first and second structural support sides, said central longitudinal opening comprising first and second inside walls and being adapted for receiving at least an upper part of a raised portion on a building surface and further having first and second insertion cavities in said mounting body, said first insertion cavity being on said top portion of a central column for providing attachment capabilities to said mounting body;

(b) providing a transparent snow-holding bar capable of fitting into said transparent mounting body;

(c) attaching said mounting body to a metal roof having a standing seam; and (d) providing vertical structural stiffeners and horizontal stiffeners in said mounting body.

9. A method of providing a snow guard as set forth in claim 8, wherein said transparent snow-holding bar is composed of clear acrylic.

10. A method of providing a snow guard as set forth in claim 9, wherein said transparent snow-holding bar is formed from clear acrylic.

11. A method of providing a snow guard as set forth in claim 10, wherein said transparent snow-holding bar is formed from clear acrylic.

12. A method of providing a snow guard as set forth in claim 11, further comprising providing an ice-holding bar formed from clear acrylic.

13. A method of providing a snow guard as set forth in claim 12, comprising:

providing vertical structural stiffeners (30) by walls (42) of bar supporting central columns (32) and by outside surface (38) of wall (24) and horizontal stiffeners (27) extending downwardly under top (26) as an integral part of said walls (24), and providing a rigid connection of two structural support sides (28), said top portion (26), said horizontal stiffeners (27), and said structural support sides (28) molded in a one piece ultraviolet proof, high impact, high izod polycarbonate plastic.

14. The method of providing a snow guard as set forth in claim 13, further comprising providing bar insertion cavities (46) and stops (52) in said mounting body to prevent snow-holding bar (8) from sliding through its insertion cavities.

15. A snow guard capable of being attached to a metal roof having a first roofing panel and a second roofing panel, the first and second roofing panels each having a substantially perpendicular longitudinal edge, the longitudinal edge of the first roofing panel positioned in close proximity to the longitudinal edge of the second roofing panel forming a seam, said snow guard, comprising:

(a) a transparent polycarbonate mounting body having first and second structural support sides, a bottom portion and a top portion, and a central longitudinal opening located in the bottom portion of said mounting body, wherein said mounting body is locatable on a metal roof by placement of said central longitudinal opening about a segment of a seam;

(b) a transparent snow-holding bar adapted to connect to said transparent block;

(c) vertical structural stiffeners and horizontal stiffeners in said mounting body; and (d) bar insertion cavities and stops in said mounting body to prevent said snow-holding bar from sliding through its insertion cavities.

16. The snow guard as set forth in claim 15, further comprising a transparent ice-holding bar connected to said mounting body.

17. The snow guard device as set forth in claim 16, further comprising:

a set screw translocatable within a threaded hole wherein driving the set screw into the threaded hole causes the mounting block to be fixedly located on said seam.

18. The snow guard as set forth in claim 15, wherein said transparent snow-holding bar is composed of clear acrylic.

19. The snow guard as set forth in claim 16, wherein said transparent ice-holding bar is composed of clear acrylic.

20. The snow guard as set forth in claim 19, comprising:

vertical structural stiffeners (30) provided by walls (42) of bar supporting central columns (32) and by outside surface (38) of wall (24) and horizontal stiffeners (27) extending downwardly under top (26) as an integral part of it and of walls (24) to form a rigid connection of two structural support sides (28), top portion (26), horizontal stiffeners (27), and structural support sides (28) molded in a one piece ultraviolet proof, high impact, high izod polycarbonate plastic; and bar insertion cavities (46) and stops (52) in said mounting body to prevent snow-holding bar (8) from sliding through its insertion cavities.

* * * * *